US008269632B2

(12) United States Patent
Hesch, Jr. et al.

(10) Patent No.: US 8,269,632 B2
(45) Date of Patent: Sep. 18, 2012

(54) SYSTEM AND METHOD FOR DETECTING A BREACH OF AN ELECTRONIC ARTICLE SURVEILLANCE TAG

(75) Inventors: John Hesch, Jr., Orient, OH (US); Edward J. DiCarlo, Boynton Beach, FL (US); John C. Ford, Boca Raton, FL (US)

(73) Assignee: Sensomatic Electronics, LLC, Boca Raton, FL (US)

( * ) Notice: Subject to any disclaimer, the term of this patent is extended or adjusted under 35 U.S.C. 154(b) by 596 days.

(21) Appl. No.: 12/477,353

(22) Filed: Jun. 3, 2009

(65) Prior Publication Data

US 2010/0308998 A1 Dec. 9, 2010

(51) Int. Cl.
*G08B 13/14* (2006.01)

(52) U.S. Cl. ..... 340/572.8; 340/10.1

(58) Field of Classification Search ..... 340/572.8, 340/10.3

See application file for complete search history.

(56) References Cited

U.S. PATENT DOCUMENTS

| | | | | |
|---|---|---|---|---|
| 6,535,130 | B2 | 3/2003 | Nguyen et al. | |
| 2005/0270155 | A1 * | 12/2005 | Sayegh | 340/572.1 |
| 2009/0212920 | A1 * | 8/2009 | Yang | 340/10.3 |
| 2009/0303046 | A1 * | 12/2009 | Eckert et al. | 340/568.4 |

* cited by examiner

*Primary Examiner* — Shirley Lu
(74) *Attorney, Agent, or Firm* — Alan M. Weisberg; Christopher & Weisburg, P.A.

(57) ABSTRACT

An EAS tag is provided having improved anti-defeat devices and methods. A pin assembly is coupled to a lanyard and includes a reduced cross-sectional profile that may be passed through a monitored article to produce no damage or minimal damage to the monitored article. The pin assembly engages a spring clamp provided in the EAS tag and is electrically coupled to an intermediate spring contact that provides an electrical current to a PC board for arming the EAS tag. A force may be applied to the intermediate spring contact to generate a reset signal that disarms the EAS tag. An alarm signal is generated if current to the PC board is disrupted without a corresponding reset signal, such as if the pin assembly is removed without rotating the intermediate spring contact or if the lanyard is cut. The tag body is provided with an arcuate channel through which an arcuate detacher probe can be guided for releasing the attaching assembly part.

14 Claims, 10 Drawing Sheets

SYSTEM AND METHOD FOR DETECTING A BREACH OF AN ELECTRONIC ARTICLE SURVEILLANCE TAG

CROSS-REFERENCE TO RELATED APPLICATION n/a

STATEMENT REGARDING FEDERALLY SPONSORED RESEARCH OR DEVELOPMENT n/a

FIELD OF THE INVENTION

This invention relates to electronic article surveillance ("EAS") tags, and in particular to EAS tags having anti-defeat mechanisms.

BACKGROUND OF THE INVENTION

Electronic article surveillance systems are used for inventory control and to prevent theft or unauthorized removal of articles from a controlled area. The EAS systems include transmitters, receivers, and EAS tags. Typically, the transmitters and the receivers are positioned at entry/exit points of the controlled area and the EAS tags are affixed to articles that are located within the controlled area. The EAS tags include a marker or a sensor that receives the transmitter signals and generates a response signal that is detected by the receiver. The EAS system generates an alert signal when the response signal is detected within a predefined distance of the receiver.

A variety of EAS tags exist, including multi-use EAS tags and disposable EAS tags. The multi-use EAS tags include releasable attachment devices for affixing the tags to the monitored articles. The attachment devices are designed to be releasable by authorized personnel. EAS tags are designed to minimize unauthorized removal of the EAS tags from monitored articles. Typically, attachment devices are releasable only through the use of an associated special tool or detaching mechanism. By contrast, disposable EAS tags are permanently affixed to the monitored articles and are deactivated by authorized personnel prior to removal from the controlled area.

U.S. Pat. No. 6,535,130 (the '130 patent), entitled Security Apparatus for Electronic Article Surveillance Tag, the disclosure of which is incorporated herein by reference, discloses multi-use EAS tags that are releasable from monitored articles. The release mechanism is a detacher device having an arcuate probe that is inserted into an arcuate channel of the tag and contacts a spring clamp mechanism. The spring clamp mechanism is a releasable locking mechanism that captures a tack assembly that is inserted into an opening in the tag body.

FIG. 1 illustrates a conventional EAS tag 100 disclosed in the '130 patent. The EAS tag 100 includes a lanyard 102 that attaches around or through a portion of a monitored article. A loop 103 is provided on one end of the lanyard 102 to secure the lanyard 102 to the body of the EAS tag 100 using a tack head 104A. As illustrated, the lanyard 102 is placed through a slit 105 and the loop 103 is positioned within a recessed area 106. A tack body 104B passes through the loop 103 and inserts into an opening 107 in the EAS tag 100. The tack assembly 104 is releasable from the EAS tag 100.

Existing EAS tags secure one end of the lanyard to the EAS tag housing and use a separate tack structure to secure the lanyard loop against the EAS tag housing. The lanyard provides one mechanical connection point to the EAS tag. What is needed is an EAS tag having a lanyard with two mechanical connection points so that current can be directed through the lanyard to provide a break detection circuit.

Additionally, existing EAS tags include loop dimensions that are much larger than the lanyard diameter and therefore define the opening size that is able to receive the lanyard. The separate tacks have bulky heads to prevent the lanyard loop from slipping over the tack head. The separate tacks are easily misplaced, which causes unnecessary frustration to users and replacement costs. What is needed is an EAS tag that is not readily defeatable and which does not include a lanyard loop or a separate tack arrangement.

SUMMARY OF THE INVENTION

The invention advantageously provides a method and system for providing a break detection circuit that employs a lanyard with two mechanical connection points that enables current to pass through the lanyard. In accordance with one embodiment, the present invention provides an electronic article surveillance (EAS) tag that includes a tag body defining an interior and having an opening leading into the interior. A circuit board is disposed in the tag body interior. The EAS tag includes a lanyard having a first end and a second end opposite the first end, where the first end is electrically coupled to the circuit board. A pin body is electrically coupled to the second end of the lanyard, and is insertable into the tag body opening. A clamp is disposed in the tag body interior and is adapted to receive the pin body. A spring contact is disposed in the tag body. The spring contact is electrically coupled to the clamp and the circuit board to provide a current path for electrical signals.

In accordance with another aspect, the present invention provides a method of securing an electronic article surveillance (EAS) tag to an article. The EAS tag includes a tag body defining a tag body interior and an alarm disposed in a tag body interior. The EAS tag further includes an electrically conductive lanyard having a first end and a second end opposite the first end. The first end is fixedly coupled and electrically coupled to a circuit board provided in the tag body interior. The second end is coupled to a pin body. The pin body is electrically couplable to the circuit board. The tag body further houses a clamp to mechanically lock the pin body at last partially inside the tag body. The lanyard is attached to the article by one of inserting the lanyard through an opening in the article and wrapping the lanyard around at least a portion of the article.

The pin body is inserted into the tag body interior. A force is applied to the pin body to cause the pin body to lock into the clamp in the tag body interior. The tag body interior further includes a spring contact to electrically couple the clamp to the circuit board to create a enable a current to flow from the circuit board, through the lanyard, the clamp and the spring contact before returning to the circuit board.

According to another embodiment, an electronic article surveillance (EAS) tag is provided and includes a tag body that defines an interior having an opening that leads into the interior of the tag body and a lanyard mounting structure that is coupled to the tag body. The securing device includes a lanyard having a first end and a second end opposite the first end. The first end is coupled to the lanyard mounting structure in the tag body interior. The securing device further includes a fastener that is coupled to the second end of the lanyard and a pin assembly that is coupled to the fastener. The lanyard, the fastener and the pin assembly have substantially equivalent cross-sectional profiles. The substantially equivalent cross-sectional profiles facilitate threading the lanyard, the fastener and the pin assembly through small openings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Before describing in detail exemplary embodiments that are in accordance with the present invention, it is noted that like reference designators refer to like elements. Referring now to the figures, as used herein, relational terms, such as "first" and "second," "top" and "bottom," and the like, may be used solely to distinguish one entity or element from another entity or element without necessarily requiring or implying any physical or logical relationship or order between such entities or elements. The terms "upper" and "lower" refer only to the orientation of the EAS tag and are not structural limitations.

Figure 1:
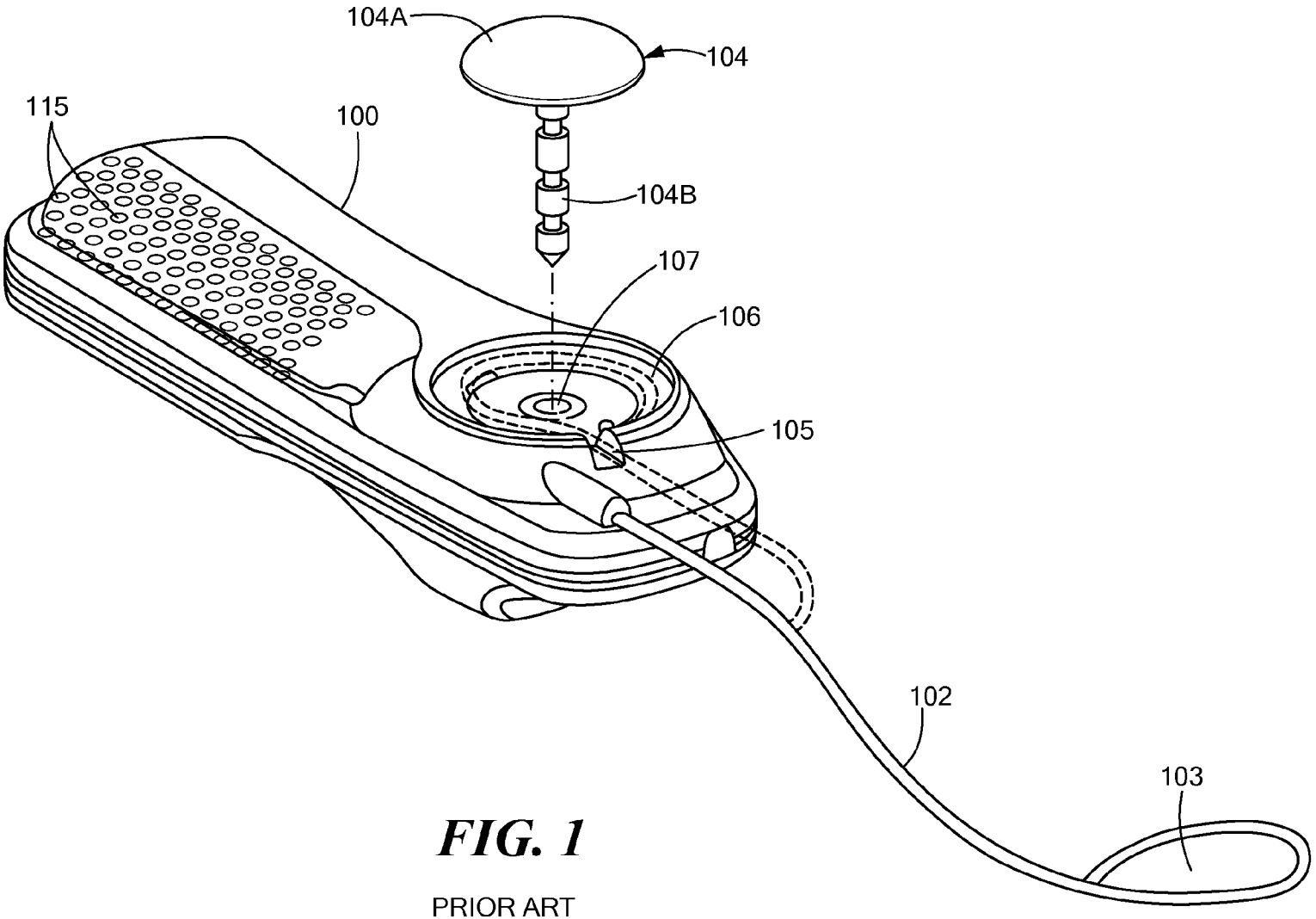
FIG. 1 PRIOR ART
FIG. 1 illustrates a conventional EAS tag.
Figure 2:
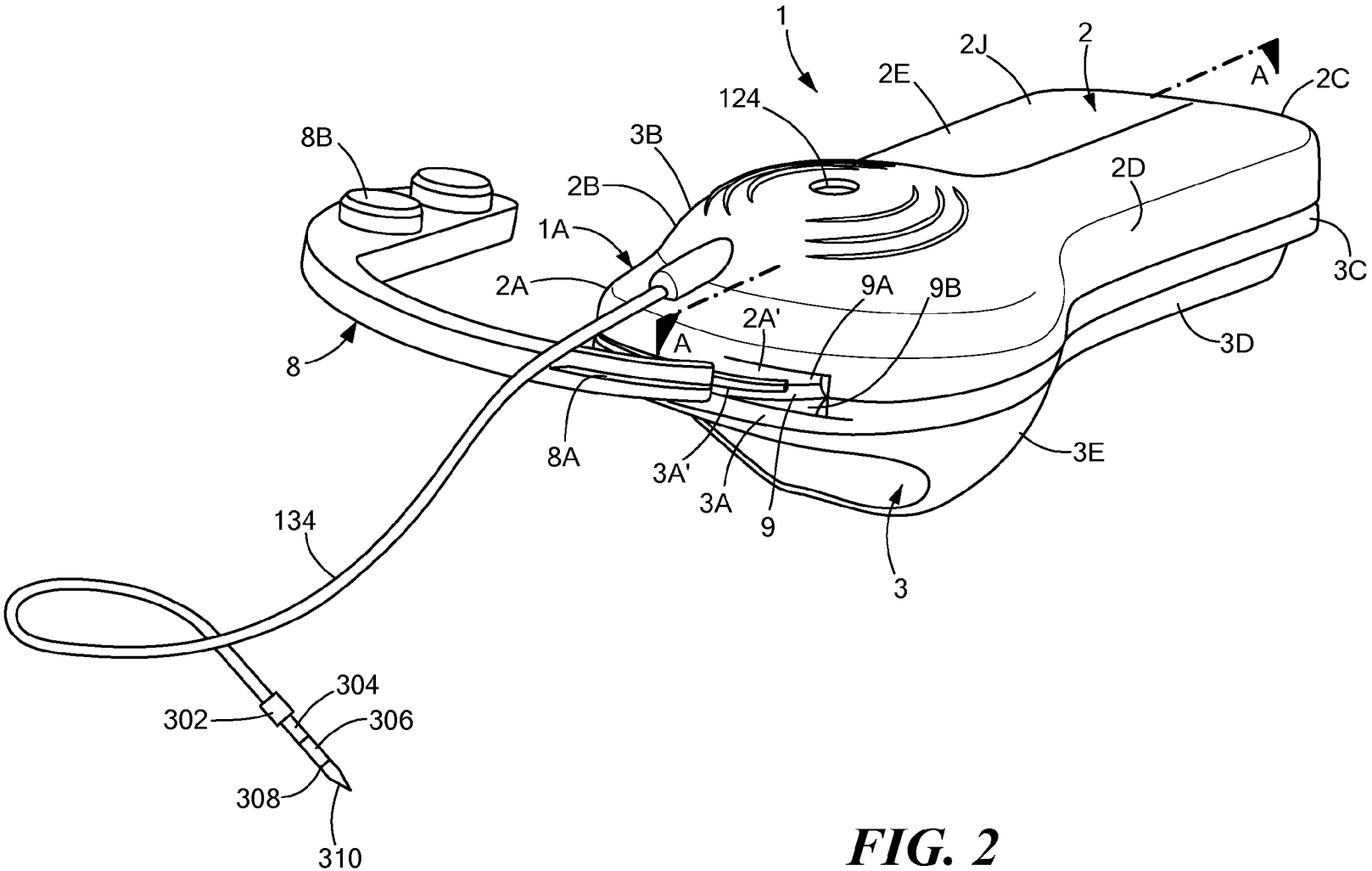
FIG. 2 illustrates a view of the exterior of a EAS tag according to one embodiment of the invention.

FIG. 2 illustrates a tag 1 that includes an upper housing 2 having side walls 2A, 2B, 2C and 2D that are joined by a top wall 2E. The EAS tag 1 also includes a lower housing 3 having side walls 3A, 3B, 3C and 3D that are joined by a bottom wall 3E. The upper and lower housings 2 and 3 are joined or mated along corresponding or associated side wall pairs (2A, 3A), (2B, 3B), (2C, 3C) and (2D, 3D) to form a closed tag body 1A defining an interior. The housings 2 and 3 are preferably made of a hard or rigid material such as, for example, an injection molded ABS plastic. If a plastic is used, the mating side walls of the housings can be joined by an ultrasonic weld 1B or like joining mechanism. A lanyard 134 is mechanically and electrically coupled to an alarming device. The lanyard 134 includes a pin assembly 304 at one end portion that is mechanically coupled with a fastener 302. The pin assembly 304 includes a pin body 306, a circumferential groove 308 and a pointed end 310.

Figure 3:
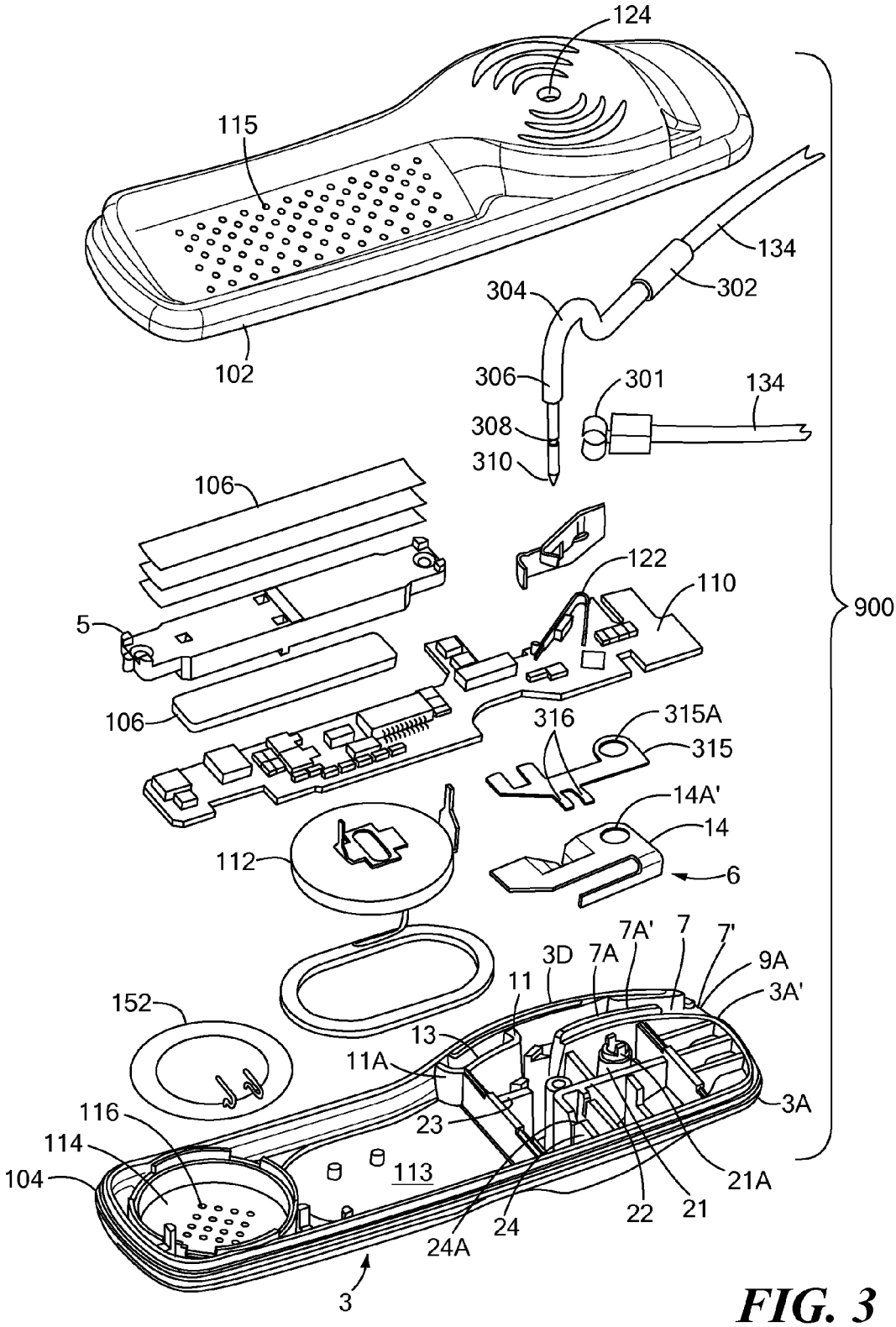
FIG. 3 illustrates a view of the interior of a EAS tag according to one embodiment of the invention.
Figure 4:
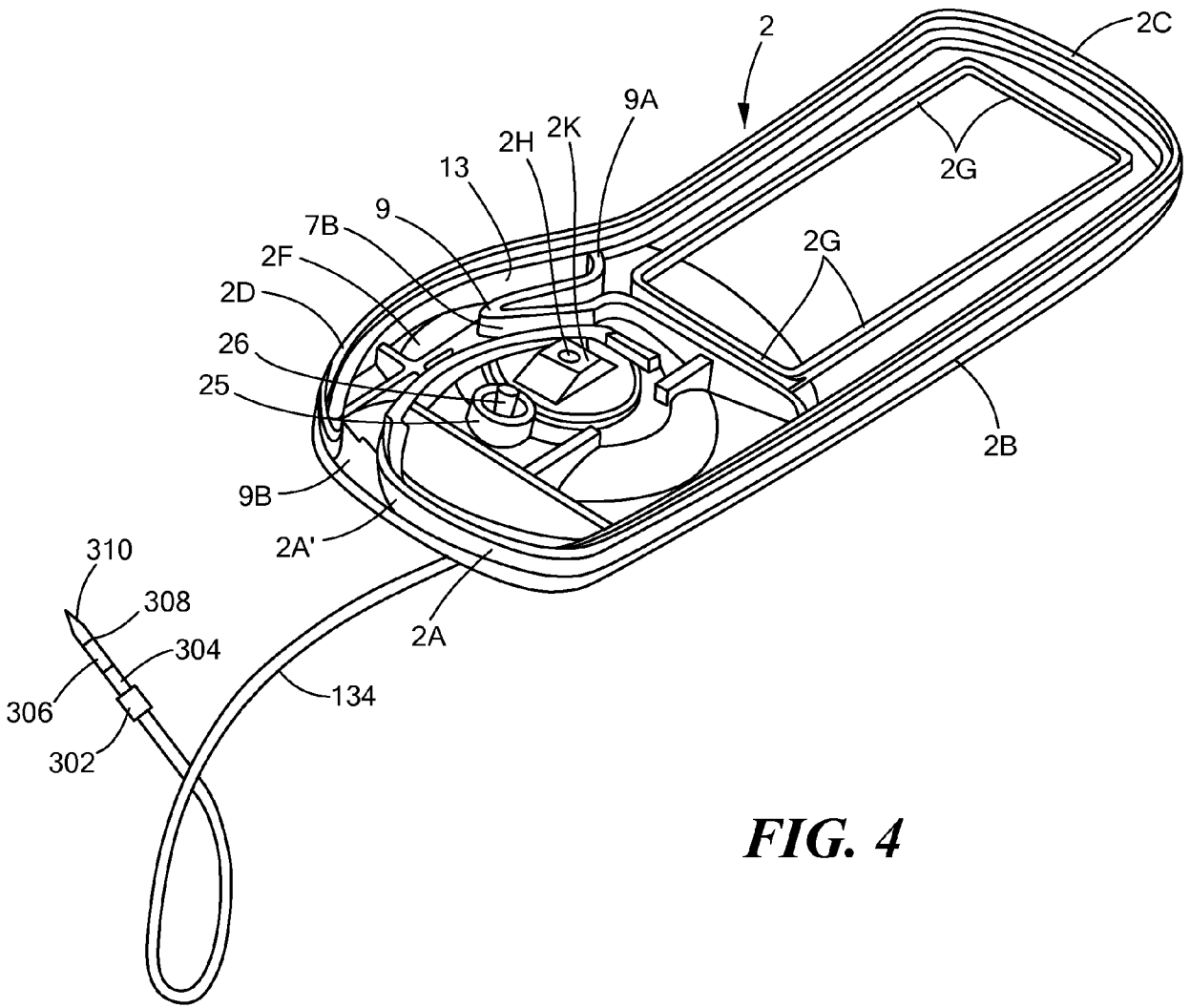
FIG. 4 illustrates a view of the interior of the upper housing of a EAS tag according to one embodiment of the invention.

Referring to FIGS. 3 and 4, the inner surfaces 2F and 3F of the walls 2E and 3E of the housings 2 and 3 are provided with frame members 2G and 3G which together define an interior cavity 1C for receiving an EAS sensor 5. The EAS sensor 5 can be any sensor that generates detectable EAS signals, and may be an acoustically or mechanically resonant magnetic sensor. An arcuate channel 7 is defined by a curved inner wall 7A. This wall extends upward from the inner surface of the bottom housing 3 to abut the inner surface 2F of the upper housing 2. The wall 7A is further spaced from the side wall 3D of the bottom housing 3 and its outward end 7A' terminates at an inward curved part 3A' of the side wall 3A. The inward curved part 3A' of the wall 3A results in a space or slot 9A defined between the side walls 3A and 3D of the lower housing 3. The upper housing 2 includes an opening 40 for the lanyard 134. The lanyard 134 includes a pin assembly 304 at one end portion that is mechanically coupled with a fastener 302. The pin assembly 304 includes a pin body 306, a circumferential groove 308 and a pointed end 310.

The slot 9A cooperates with a similar slot 9B between the side walls 2A and 2D of the upper housing 2 to define a second opening 9 for providing entry or access into the outward end 7' of the channel 7. At this entry point, the side wall 2A also curves inwardly at a part 2A', the latter part 2A' mating with the curved side wall part 3A' of the side wall 3 of the lower housing 3.

The channel 7 is further defined by a second curved wall 7B of FIG. 4 that extends downwardly from the inner surface 2F of the upper housing 2. The wall 7B is situated outward of the inner end 7A" of the curved wall 7A and extends beyond this end to the frame member 2G.

Figure 5:
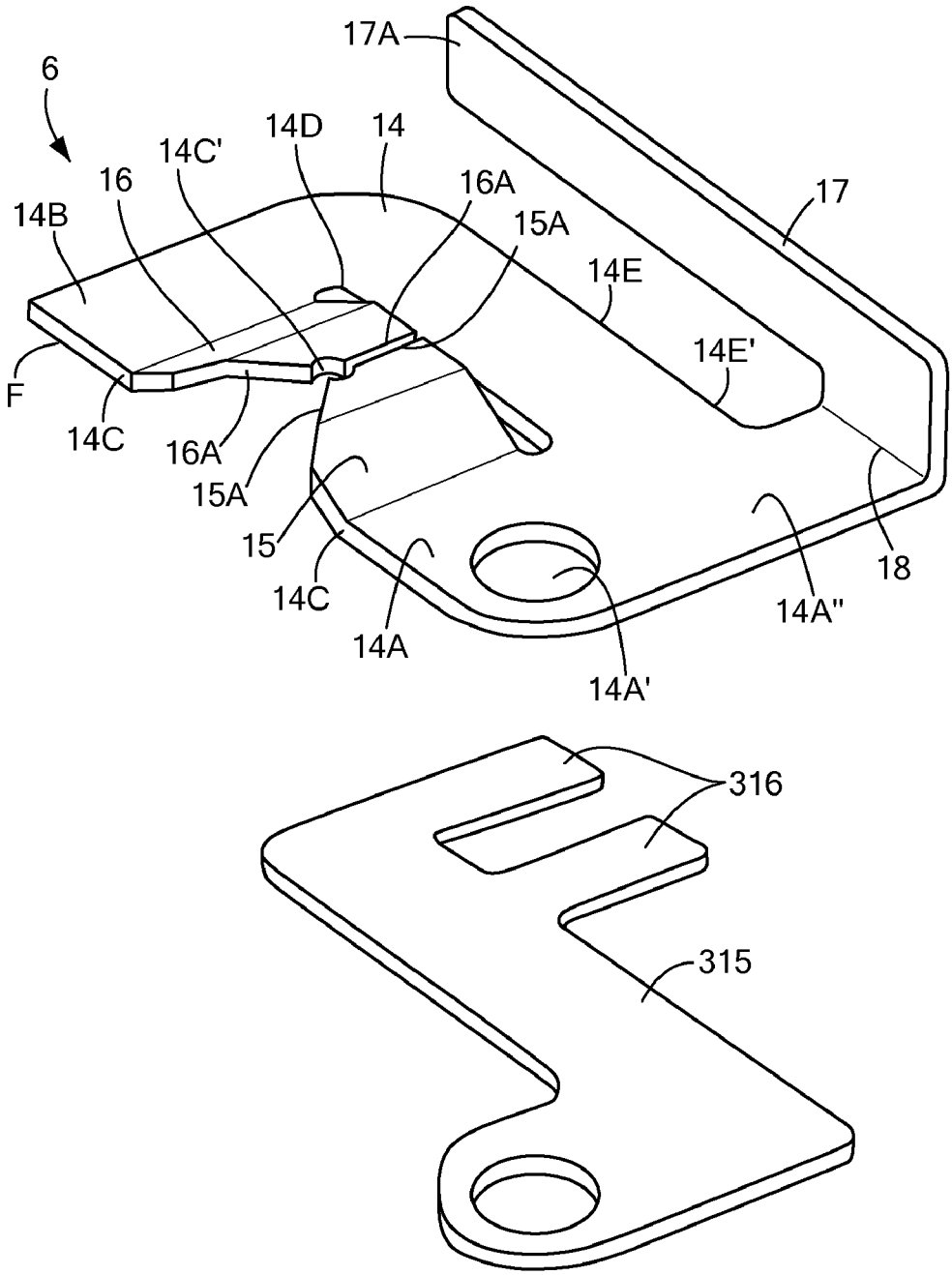
FIG. 5 illustrates an exploded view of the spring clamp and an intermediate spring contact used in the EAS tag of FIG. 3.

FIG. 5 illustrates a conventional locking member 6 that is provided within the tag body 1A for releasably preventing a pin body 306 from being withdrawn from the tag body. The pin assembly 304 and the monitored article 51 thus become releasably locked to the EAS tag 1 by the locking member 6. The EAS tag 1 is designed so that access to the locking member 6 for releasing the pin assembly 304 is made difficult for other than authorized personnel. For example, the tag body 1A is configured so that access to the locking member 6 is through an arcuate channel 7 defined by one or more inner walls and by parts of the side walls and upper and lower walls of the tag body 1A. With this configuration, a special arcuate probe 8 is needed to reach and release the locking member 6 to detach the pin assembly 304 and the article from the tag body 1A. The configuration of the channel 7 changes at its inner end 7" to define a keyway for the channel 7 which receives the probe 8 that passes through the channel 7 to gain access to the locking member 6. For example, the channel cross section may change from substantially rectangular to substantially L-shaped.

Figure 6:
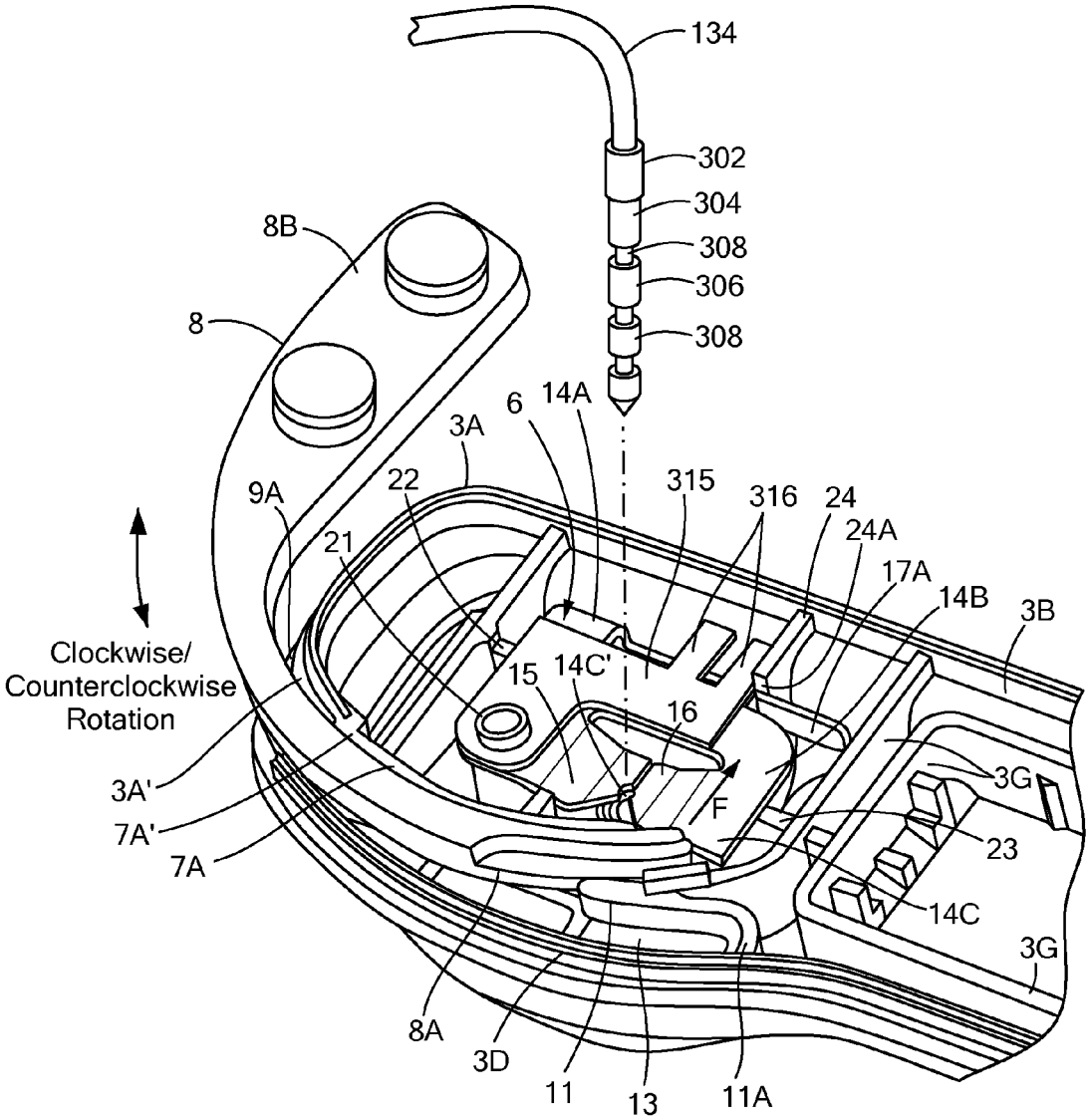
FIG. 6 illustrates a partial views of the interior of the lower housing of the EAS tag of FIG. 2 with the probe inserted in the arcuate channel of the EAS tag.

FIG. 6 is an enlarged view of the section of the lower housing 3 containing the locking member 6 and the arcuate channel 7. The arcuate probe 8 is shown as received in and guided by the channel 7 to the locking member 6 for the purpose of releasing same. The forward end 8A of probe 8 is L-shaped and, thus, fits within the L-shaped keyway defined by inner end 7" of the channel.

Adjacent the inner end 7" of the channel 7, the lower and upper housings 2 and 3 are provided with further curved walls 9 and 11 that terminate in wall sections 9A and 11A abutting the end walls 2D and 3D. The walls 9 and 11 are positioned outward of the channel 7 and, with the end walls 2D and 3D, define a trap area 13, which prevents access to the member 6. This area provides a safety measure for blocking unauthorized objects that may be introduced into the channel 7 of the tag body 1A in an attempt reach the locking member 6.

The locking member 6 is provided to releasably prevent the pin body 306 from being withdrawn from the tag body 1A. More particularly, the locking member 6 is adapted to accommodate release of the pin body 306 via the arcuate probe 8 that travels down the arcuate channel 7. The locking member 6 is shown in detail in FIG. 6 and in an exploded view in FIG. 5.

The locking member 6 maybe a spring clamp having a clamp body 14 and jaws 15, 16. The clamp body includes a mounting part 14A extending laterally of the jaw 15 and a release part 14B extending laterally of the jaw 16. The mounting part 14A includes a mounting aperture 14A'. The jaws 15, 16 extend outwardly of the plane defined by the clamp body 14 and then extend inwardly toward the other jaw. The jaws 15, 16 terminate in facing edges 15A and 16A. These edges extend from a common edge 14C of the clamp body 14 inwardly toward each other, then curve outwardly away from each other to define an aperture 14C' (typically, circular or elliptical) for receiving the pin body 306. The edges 15A and 16A then continue in aligned fashion and end in an elongated, lateral slot 14D in the clamp body 14. The latter slot lies inward of a further clamp body edge 14E, which opposes the clamp body edge 14C.

A further laterally extending elongated spring sleeve or arm 17 is attached to the clamp body 14 by a joint area 18 located on the side 14E' of the edge 14E that borders the mounting part 14A. The sleeve 17 extends along the length of the edge 14E and is provided outside the plane defined by the clamp body 14.

Referring to FIG. 3, the lower housing 3 of the tag body 1A includes a hollow circular mount 21 with a lip 21A and support walls 22, 23 and 24 to mount and support the spring clamp 14. The clamp is mounted, via the aperture 14A' of the mounting part 14, on the mount 21 with the area of mounting part adjoining the aperture 14A' supported on the lip 21A. A circular wall 25 of the upper housing 3 and a central cylindrical stud 26 of this housing (see FIG. 4) maintain the mounting part 14A in its mounted position, while allowing the mounting part to be rotated. The spring clamp 14 therefore pivots about the mounting part.

The back end 14A" (shown in FIG. 5) of the mounting part 14A and the lateral part of the spring clamp 14 that connect the mounting part 14A and the release part 14B are supported on the support walls 22 and 24, while the release part is carried by the wall 23. The spring sleeve 17 rests with one end 17A in a slot 24A in the support wall 24.

The pointed end 310 of the pin body 306 is introduced in the downward direction through the opening 124 in the upper housing 2 and into the aperture 14C' defined by the facing edges 15A, 16A of the jaws. This causes the jaws to spread or open and allow the pin body 306 to pass through the jaws. When the downward travel of the pin body 306 is stopped at a desired circumferential groove 308, the jaws 15, 16 retract and clutch the pin body 306. In this position, the jaws 15, 16 prevent upward movement of the pin assembly 304.

The arcuate probe 8 is introduced into the opening of the tag body 1A (as shown in FIG. 2) to release the pin assembly 304 from the tag body 1A via rotation of the probe about its rearward end 8B. This causes the arcuate probe 8 to move into and be guided by the channel 7 until the L-shaped forward end 8A of the arcuate probe 8 reaches and passes into the L-shaped inner end 7" of the channel 7. This brings the probe end 8A to the part of the common edge 14C that borders the release part 14B of the clamp body 14.

By applying continued pressure on the arcuate probe 8, a force is applied on the release part 14B of the clamp body 14. This applied force causes the clamp body 14 to rotate about the support area 14A on the mount 21 and causes the jaws 15, 16 to spread apart. The aperture 14C' expands to release the pin body 306 from the grip or clutch of the jaws 15, 16. The pin assembly 304 moves in an upward direction to withdraw and separate from the tag body 1A.

During rotation of the clamp body 14 from the in-plane force exerted by the probe 8, the spring arm 17 is compressed at the joint 18. After the pin assembly 304 separates from the tag body 1A, the arcuate probe 8 is disengaged from the release part 14A of the spring clamp 14 as the arcuate probe 8 is withdrawn from the channel 7. With the force on the spring clamp 14 removed, the spring arm 17 expands. This causes the spring clamp 14 to rotate in an opposite direction about the support area 14A. The spring clamp 14 is brought back to its original position awaiting reentry of the pin body 306.

Referring again to FIG. 3, the EAS tag 1 is illustrated incorporating the anti-defeat embodiments of the present invention. A pin assembly 304 may be provided at an end portion of the lanyard 134 to mechanically and electrically couple the lanyard 134 to an alarming device. A clip 301 may be provided at a second end portion of the lanyard 134 to secure the lanyard 134 to the circuit board 110. According to one embodiment, the pin assembly 304 may include cross-sectional dimensions that are substantially similar to cross-sectional dimensions of the lanyard 134. For example, the pin assembly 304 may include a circumferential cross-section that is substantially similar to a circumferential cross-section of the lanyard 134. The pin assembly 304 may be formed into one of several shapes for insertion into aperture 124. For example, the pin assembly 304 may be formed in a curvilinear shape or a linear shape, including a rod shape, a hook shape or other shapes.

The pin assembly 304 may include a pin body 306 having one or more slots or circumferential grooves 308 that latch into the spring clamp 14 and a pin tip 310. The pin assembly 304 may be integrally formed with the lanyard 134. Alternatively, the pin assembly 304 may be formed separately from the lanyard 134 and may be coupled to the lanyard 134. The pin assembly 304 may be electrically and mechanically coupled to the lanyard 134 using a fastener, such as a ferrule 302 or other fastener. The ferrule 302 may use several techniques for fastening the lanyard 134 and the pin assembly 304, including gripping, soldering, brazing, crimping, welding, or laser fusing, among other fastening techniques. The fastener provides a thin connection that maintains the cross-sectional profile of the pin assembly 304 and the lanyard 134. Thus, the pin assembly 304, the ferrule 302 and the lanyard 134 may be inserted through small holes in articles to secure the EAS tag 1 to the article, while causing no damage or minimal damage to the article.

After the lanyard 134 is passed through the article to be monitored, the pin assembly 304 is inserted into the aperture 124 to physically secure the EAS tag 1 to the article and to establish an electrical connection that engages an alarm system. According to one embodiment, the pin body 306 is mechanically coupled within the EAS tag 1 by the clamp body 14. For example, the aperture 14C' of the clamp body 14 engages the circumferential groove 308 in the pin body 306 to mechanically secure the pin body 306. An intermediate spring contact 315 is provided to electrically couple the pin body 306 to the printed circuit ("PC") board 110.

The EAS tag 1 may include several elements, such as a battery 112, a piezo transducer 152, the sensor 5, sensor shield 106, pin switch 122, spring contact 315, and locking member 6, among other elements. The EAS tag 1 may include several features, such as apertures 115,116, battery cavity 113, and a piezo transducer cavity 114, among other features.

Battery 112 fits into cavity 113 and a piezo transducer 152 fits into cavity 114. Both are used in conjunction with circuitry on PC board 110 to form the alarm. The alarm can be configured so that battery 112 can be placed into cavity 113 or cavity 114, and the piezo transducer can be placed into the unused cavity.

Figure 7:
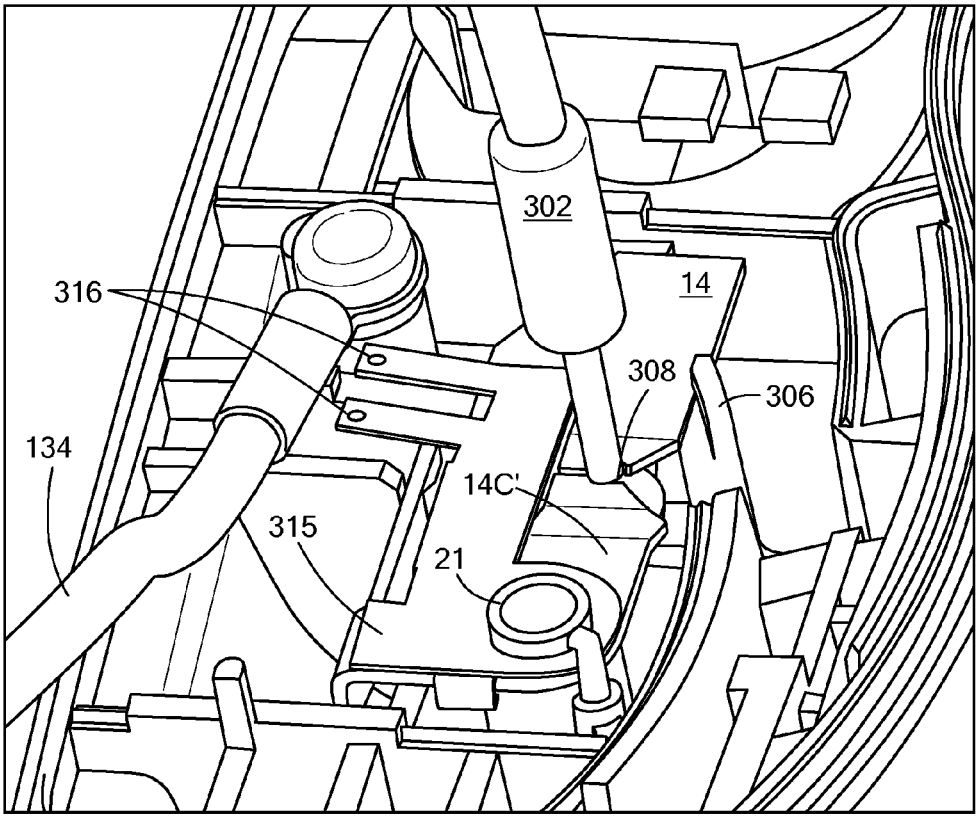
FIG. 7 illustrates an exploded view of a spring clamp and an intermediate spring contact positioned in the EAS tag of FIG. 2 according to one embodiment of the invention.

Referring to FIG. 7, the intermediate spring contact 315 is mechanically and electrically coupled to the clamp body 14 and includes an aperture 315A for mounting to the circular mount 21. The intermediate spring contact 315 therefore pivots about the circular mount 21. The projections 316 are configured to electrically couple the spring contact 315 to the PC board 110. Thus, an electrical signal originating from the PC board 110 travels through the lanyard 134, the ferrule 302, the pin assembly 304, the clamp body 14, and the intermediate spring contact 315, before returning to the PC board 110.

Figure 8:
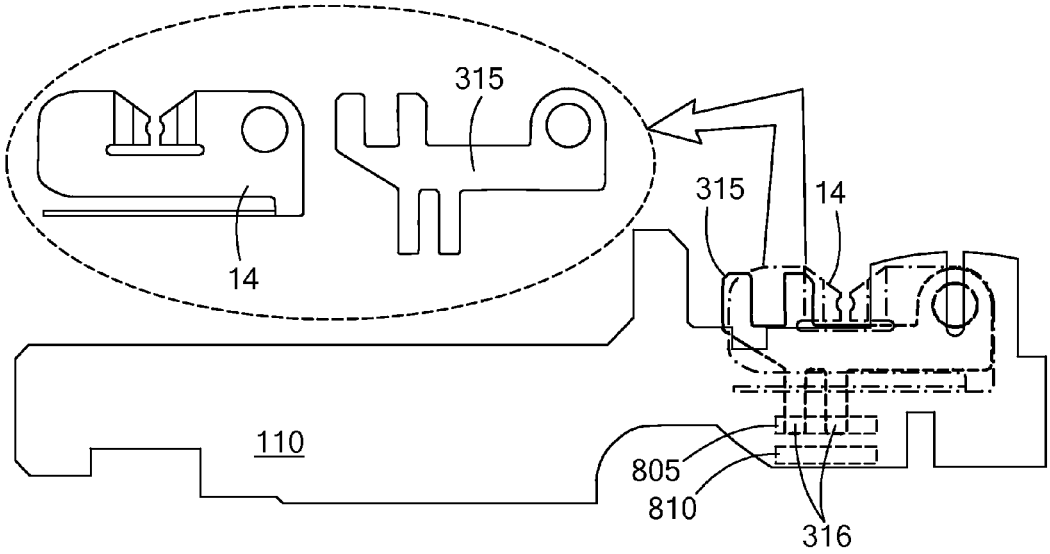
FIG. 8 illustrates an exploded view of a first orientation between an intermediate spring contact and a circuit board according to one embodiment of the invention.
Figure 9:
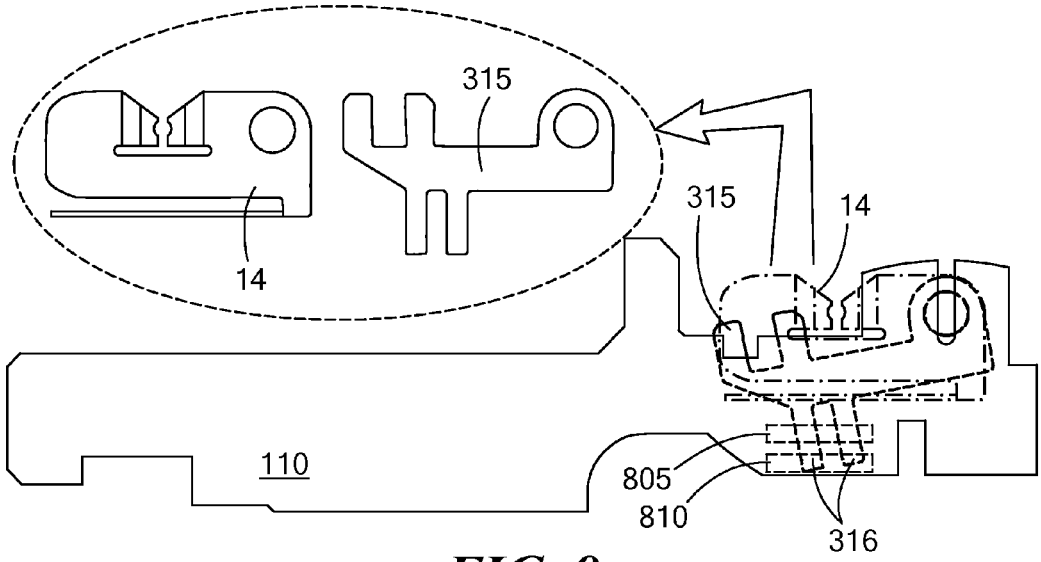
FIG. 9 illustrates an exploded view of a second orientation between an intermediate spring contact and a circuit board according to one embodiment of the invention.

FIGS. 8 and 9 illustrate a first orientation and a second orientation, respectively, of the intermediate spring contact 315 relative to the PC board 110. In the first orientation, the lanyard 134 is secured in the EAS tag 1 and the pin body 306 is locked in the aperture 14C' of the clamp body 14. In the first orientation, the projections 316 provide an electrical connection with the pad 805 to produce a signal placing the EAS tag 1 in an "armed" state. In the armed state, the EAS tag 1 may generate an alert, such as sounding an audible alarm, flashing an LED or other alert when the electrical contact is disconnected, such as by pulling the pin assembly 304 out of the EAS tag 1, cutting the lanyard or otherwise disconnecting the electrical contact.

In the second orientation, the clamp body 14 and the intermediate spring contact 315 are provided with a rotational force to release the pin assembly 306 from the aperture 14C' of the clamp body 14. For example, the rotational force may be applied by the special arcuate probe 8. When the intermediate spring contact 315 rotates about the mount 21, the projections 316 contact pad 810 to produce a "reset" signal that deactivates the alarm system. In order to provide the system with time to receive the reset signal, a time delay may be provided between when the electrical signal flowing through pad 805 is disrupted and when an alert is generated. After entering the reset state, the EAS tag 1 will not generate an alert, such as sounding an audible alarm, flashing an LED or other alert when the electrical contact is disconnected, such as by pulling the pin assembly 304 out of the EAS tag 1, cutting the lanyard or otherwise disconnecting the electrical contact.

According to one embodiment, a pin switch 122 may be provided to form a second electrical connection with the pin body 306. Upon insertion into the EAS tag 1, the pin body 306 abuts and moves the pin switch 122 to form an electrical contact on the PC board 110, thereby "arming" the EAS tag 1. Once the EAS tag 1 is armed, if either the electrical signal flowing through the pad 805 is disrupted or the switch 122 are opened, then the EAS tag 1 may sound an alarm. If only the pin switch 122 was used to "arm" the EAS tag 1, then the lanyard 135 could be cut and the EAS tag 1 would not alarm. Once armed, the EAS tag 1 may be disarmed or turned off by rotating the intermediate spring contact 315 about the mount 21 to produce the "reset" signal by contacting the projections 316 against contact pad 810. The EAS tag alarm switch logic is fully described in FIG. 10.

Figure 10:
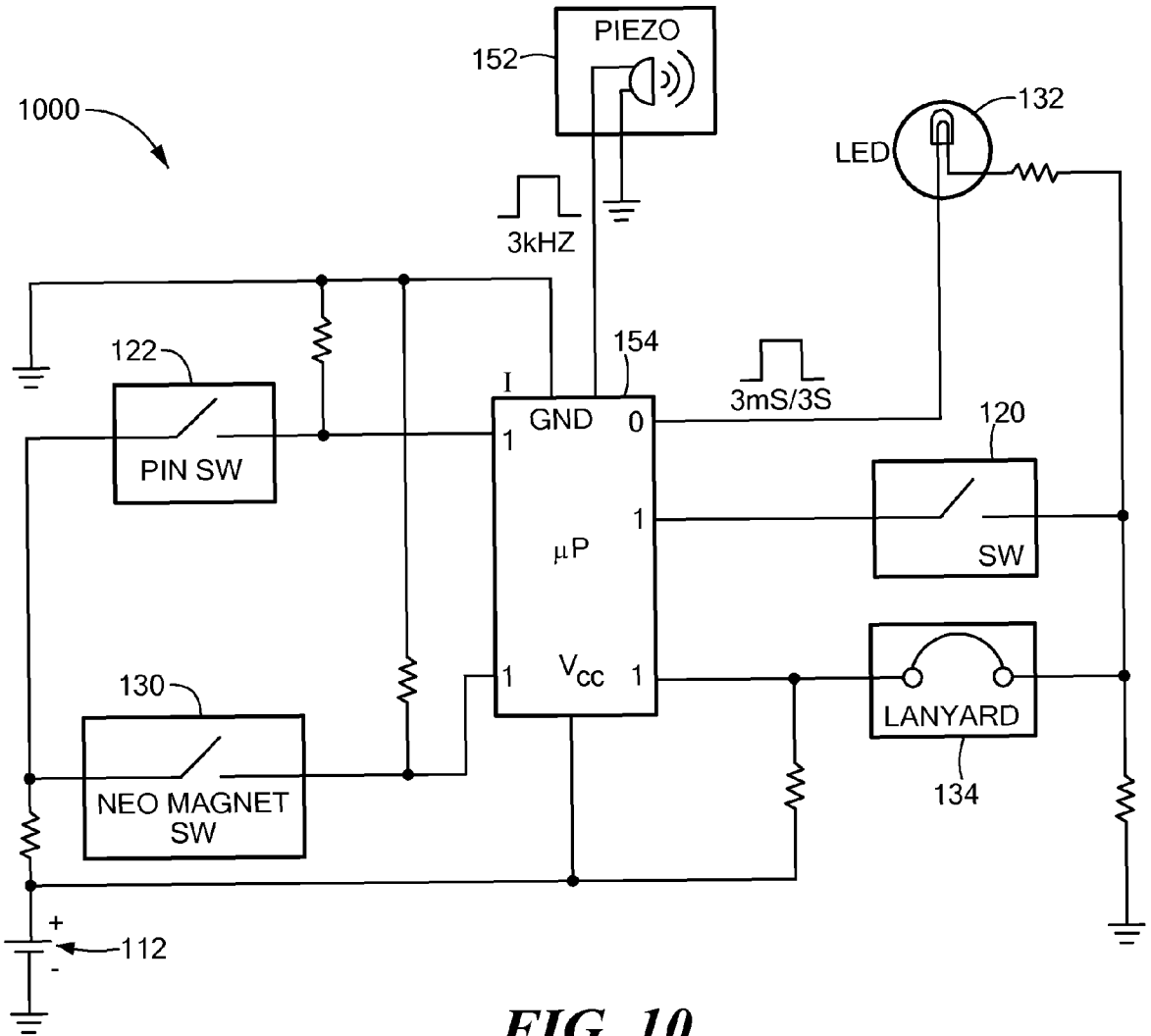
FIG. 10 illustrates a block diagram of one embodiment of the tag alarm according to one embodiment of the invention.

FIG. 10 illustrates an electrical schematic of a self-alarming tag alarm 1000 to prevent tag defeat. Tag alarm 1000 emits an alarm signal that may include an audible alarm, flashing light, an RF signal, or other alarm signal, to a remote device. The alarm signal is different from an alert signal that is emitted by the EAS system when the EAS tag 1 is carried into an interrogation zone. Printed circuit (PC) board 110 contains the circuitry for the tag alarm 1000, which emits the alarm signal if the EAS tag 1 is detached from the monitored article by other than detacher probe 8.

The series of apertures 115 and 116 through the upper and lower tag housing members, respectively, cover the area adjacent both cavities 113 and 114. Because the apertures cover the area adjacent cavities 113 and 114, the apertures 115 and 116 cannot be used as a localized target to direct a probe to the piezo in an attempt to destroy or damage it. A probe forced directly into the piezo could damage or destroy the piezo, but a probe indiscriminately inserted into the EAS tag 1 could set off the tag alarm.

Sensor shield 106 may be placed on one or both sides of sensor 5 to prevent one mode of defeat where a metal probe, screw driver, or the like, is forced through upper or lower tag housing members 102 or 104, respectively, to damage or destroy sensor 5 or piezo transducer 152. Once sensor 5 or piezo transducer 152 is destroyed, the article to which EAS tag 1 is attached can be moved through the interrogation zone without setting off the EAS alarm. Sensor shield 106 is preferably made of a nonferrous metal such as stainless steel or other very hard material that does not effect the operation of sensor 5, but which is capable of making the insertion of a metal probe or the like to damage sensor 5 or piezo transducer 152 extremely difficult. The sensor shield 106 may be placed in the upper tag housing member 302, for example.

The tag alarm 1000 may sound upon unauthorized removal of pin assembly 304 from the EAS tag 1, disruption of the signal through the intermediate spring contact 315 or the pin switch 122, which are used to provide alarming logic. Referring to FIG. 10, microprocessor 155 is connected to piezo transducer 152, pin switch 122, intermediate spring contact switch 120, and battery 112. The microprocessor 154 generates the signal to drive piezo transducer 152, based upon the switch logic. The piezo transducer 152 may be driven at about 3 kHz steady, or to conserve battery life, can be pulsed, for example, at 1 Hz, or can be frequency modulated with a deviation of 250 Hz and a modulation frequency of 4 Hz, or driven in a combination of modulation techniques. The piezo transducer 152 may be any small transducer that makes an audible sound and that may be driven at relatively low power.

In addition to the switches described above, a magnet switch 130 may be connected to microprocessor 154. One embodiment of the EAS tag 1 includes a magneto-mechanical sensor 5. Magneto-mechanical sensors include a magnetostrictive resonator that resonates at a preselected frequency when biased by a magnetic field. Magnetomechanical sensors are thus affected by a magnetic field. One defeat method involves placing a relatively strong magnet next to the EAS tag 1 so the resonator is no longer biased correctly and no longer resonates at the desired frequency. If the tag does not resonate at the desired frequency, it will not be detected when moved through an interrogation zone. The EAS tag 1 may include a magnet switch 130, which is closed upon exposure to an externally applied magnetic field, thus alarming the EAS tag 1. The magnet switch 130 can be any suitable magnet switch such as a reed switch, or a wire segment with a free end positioned within an exposed wire loop, and which moves in an applied magnetic field touching the exposed wire loop to make contact and close the switch.

An LED 132 may be connected to microprocessor 154. When the EAS tag 1 is armed, the LED 132 flashes to indicate that the EAS tag 1 is active. The LED 132 can be configured to flash at a desired repetition rate, for example at 3 seconds on and 3 seconds off. To conserve battery life, the on time for the LED 132 can be pulsed or cycled at a frequency that is higher than that detectable to the human eye. Thus, during the time that the LED 132 is on, it will appear to be constant but will actually be cycling on and off very rapidly. For example, the cycle frequency for the on time should be greater than 50 Hz, such as 333 Hz. A flashing LED 132 indicates that the EAS tag 1 is armed, and will alarm if tampered with, which provides additional deterrence to defeat attempts. Upon alarming, the repetition rate of 3 seconds on and 3 second off may change. For example, the LED 132 may cycle at a faster repetition rate. When the EAS tag 1 is alarming, the response of the LED 132 may be visually different than when tag EAS 1 is in the armed state. This permits easy location of an alarming EAS tag 1 in proximity to a plurality of armed tags that are not alarming.

The lanyard 134 is connected to microprocessor 154. During use, the lanyard 134 is attached around or through an opening in a portion of the monitored article and the pin assembly 304 is inserted into the aperture 124. The end of the lanyard 134 with the pin assembly 304 can then be inserted into the aperture 124 and locked within the clamp body 14. The lanyard 134 is electrically conductive. The microprocessor 154 detects if the lanyard 134 is cut and generates an alarm.

Figure 11:
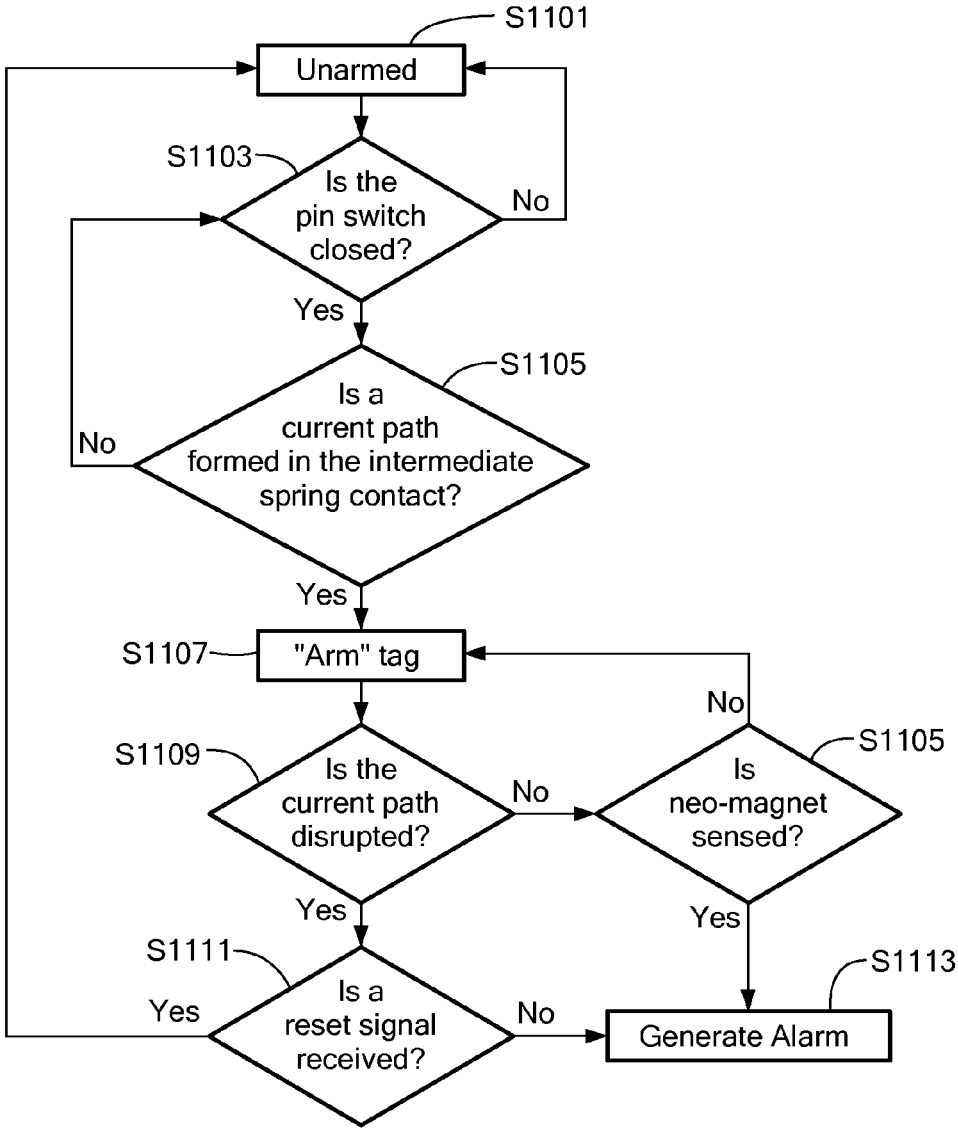
FIG. 11 illustrates a flow chart of the tag alarm switch logic according to one embodiment of the invention.

FIG. 11 illustrates a block diagram of steps performed by the microprocessor 154 for operating the EAS tag 1. The EAS tag 1 begins in the unarmed state in step S1101. A determination is made in step S1103 regarding whether the pin switch is closed. If the pin switch is closed, a determination is made regarding whether a current path is formed through the intermediate spring contact at step S1105. If the current path is formed, then the EAS tag 1 is armed at step S1107. A determination is made regarding whether the current is disrupted at step S1109. If the current is disrupted, then a determination is made whether a reset signal is generated at step S1111. If a reset signal is not generated, then an alarm signal is generated at step S1113. If a reset signal is generated, then the EAS tag is returned to the unarmed state at step 1101 and an alarm is not generated. If the current is not disrupted, then a determination is made regarding whether the magnet switch is closed by an applied magnetic field at step S1115. If the magnet switch is closed, then the alarm signal is generated at step S1113. If the magnetic switch is not closed, then the EAS tag is returned to the armed state in step S1107. If the alarm is activated at step S1113, then it may be turned off at step S1117.

The EAS tag 1 may be configured to have all of the tag defeat devices and methods described herein or any combination thereof For example, decoy tags could be used where the LED 132 flashes to indicate the tag is armed, but the tag may not have an alarm, it may only have the flashing LED. A perpetrator will not know if the EAS tags include alarm or not, as they will appear identical to the EAS tags that are equipped with alarms.

It is understood that the above-described arrangements are merely illustrative of the many possible specific embodiments, which represent applications of the present invention.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. An electronic article surveillance (EAS) tag, comprising:

a tag body defining an interior and having an opening leading into the interior;

a circuit board disposed in the tag body interior, the circuit board including a first pad and a second pad;

a lanyard having a first end and a second end opposite the first end, the first end being electrically coupled to the circuit board;

a pin body electrically coupled to the second end of the lanyard, the pin body being insertable into the tag body opening;

a clamp disposed in the tag body interior, the clamp being arranged to receive the pin body; and a spring contact disposed in the tag body, the spring contact movable between a first position and a second position, the spring contact electrically coupling the clamp and the circuit board to provide a current path for electrical signals through the lanyard, the spring contact including a projection that is electrically coupled to the first pad when the spring contact is at the first position and is electrically coupled to the second pad when the spring contact is at the second position, an armed signal being generated when the spring contact is at the first position, and a reset signal being generated when the spring contact is at the second position.

2. The EAS tag according to claim 1, wherein the pin body has a circumferential groove and the clamp engages the circumferential groove.

3. The EAS tag according to claim 1, wherein the pin assembly includes one of a curvilinear shape or a linear shape.

4. The EAS tag according to claim 1, further comprising:

a pin assembly that is mechanically and electrically coupled to the second end of the lanyard, the pin assembly comprising the pin body.

5. The EAS tag according to claim 2, wherein the pin assembly and the lanyard have a substantially equivalent cross-sectional profile.

6. The EAS tag according to claim 1, further comprising a passage defined in the tag body interior that provides a channel from an exterior of the tag body to the clamp.

7. The EAS tag according to claim 1, wherein the tag body interior includes a mount, the clamp includes a clamp aperture that receives the mount; and the spring contact includes a spring contact aperture that receives the mount, and wherein the clamp and the spring contact are configured to pivot on the mount, wherein the spring contact pivots on the mount to move the projection between the first position and the second position.

8. A method of securing an electronic article surveillance (EAS) tag to an article, the EAS tag including a tag body defining a tag body interior and an alarm disposed in a tag body interior, the EAS tag further including an electrically conductive lanyard having a first end and a second end opposite the first end, the first end being electrically fixedly coupled to a circuit board provided in the tag body interior and the second end being coupled to a pin body, the circuit board including a first pad and a second pad, the pin body being electrically couplable to the circuit board, the tag body further housing a clamp to mechanically lock the pin body at last partially inside the tag body, the alarm being electrically coupled to the circuit board, the method comprising:

attaching the lanyard to the article by one of inserting the lanyard through an opening in the article and wrapping the lanyard around at least a portion of the article;

inserting the pin body into the tag body interior;

applying a force to the pin body to cause the pin body to lock into the clamp in the tag body interior, the tag body interior further including a spring contact movable between a first position and a second position, the spring contact electrically coupling the clamp to the circuit board to enable a current to flow from the circuit board, through the lanyard, the clamp and the spring contact before returning to the circuit board, the spring contact including a projection that is electrically coupled to the first pad when the spring contact is at the first position and is electrically coupled to the second pad when the spring contact is at the second position, an armed signal being generated when the spring contact is at the first position, and a reset signal being generated when the spring contact is at the second position.

9. The method according to claim 8, further comprising disrupting the current path, the current path disruption causing the alarm to activate.

10. The method according to claim 9, wherein disrupting the current path includes at least one of disconnecting the second end of the lanyard from the clamp and cutting the lanyard.

11. The method according to claim 9, wherein the generation of the reset signal deactivates the alarm.

12. The method according to claim 11, further comprising causing the spring contact to pivot to thereby generate the reset signal.

13. The EAS tag according to claim 2, wherein the clamp includes an aperture that receives the pin body and mechanically engages the circumferential groove.

14. The EAS tag according to claim 13, wherein the aperture is configured to release the pin body.

* * * * *